US011594191B2

(12) United States Patent
Hao et al.

(10) Patent No.: US 11,594,191 B2
(45) Date of Patent: Feb. 28, 2023

(54) LIQUID CRYSTAL DISPLAY GAMMA CIRCUIT OUTPUTTING POSITIVE AND NEGATIVE GAMMA REFERENCE VOLTAGE OCCUPYING SMALLER LAYOUT SPACE

(71) Applicants: Beijing BOE Technology Development Co., Ltd., Beijing (CN); BOE Technology Group Co., Ltd., Beijing (CN)

(72) Inventors: Xueguang Hao, Beijing (CN); Yongda Ma, Beijing (CN); Hongfei Cheng, Beijing (CN)

(73) Assignees: Beijing BOE Technology Development Co., Ltd., Beijing (CN); BOE Technology GroUp Co., Ltd., Beijing (CN)

( * ) Notice: Subject to any disclaimer, the term of this patent is extended or adjusted under 35 U.S.C. 154(b) by 0 days.

(21) Appl. No.: 17/556,767

(22) Filed: Dec. 20, 2021

(65) Prior Publication Data

US 2022/0223118 A1 Jul. 14, 2022

(30) Foreign Application Priority Data

Jan. 11, 2021 (CN) ..... 202110031377.3

(51) Int. Cl.
*G09G 3/36* (2006.01)

(52) U.S. Cl.
CPC ..... *G09G 3/3696* (2013.01); *G09G 2310/08* (2013.01); *G09G 2320/0276* (2013.01)

(58) Field of Classification Search
CPC ..... G09G 3/36; G09G 3/3611; G09G 3/3614; G09G 3/3622; G09G 3/3625;
(Continued)

(56) References Cited

U.S. PATENT DOCUMENTS

2007/0188430 A1 8/2007 Moon
2008/0252632 A1* 10/2008 Im ..... G09G 3/3648 345/99

(Continued)

FOREIGN PATENT DOCUMENTS

CN 101022005 A 8/2007
CN 101063754 A 10/2007

(Continued)

OTHER PUBLICATIONS

CN202110031377.3 first office action.

*Primary Examiner* — Alexander Eisen
*Assistant Examiner* — Nelson Lam
(74) *Attorney, Agent, or Firm* — IPro, PLLC

(57) ABSTRACT

The present disclosure relates to the field of display technologies, and provides a gamma circuit. The gamma circuit includes: a plurality of positive gamma voltage output terminals, a plurality of negative gamma voltage output terminals in one-to-one correspondence with the plurality of positive gamma voltage output terminals, and a plurality of voltage conversion circuits. Each of the voltage conversion circuits is configured to output a negative gamma reference voltage to the negative gamma voltage output terminal based on a positive gamma reference voltage output by the positive gamma voltage output terminal corresponding to the negative gamma voltage output terminal.

19 Claims, 4 Drawing Sheets

(58) Field of Classification Search
CPC .. G09G 3/3648; G09G 3/3674; G09G 3/3677; G09G 3/3681; G09G 3/3685; G09G 3/3688; G09G 3/3692; G09G 3/3696; G09G 2320/0276
USPC ..... 345/87–104
See application file for complete search history.

(56) References Cited

U.S. PATENT DOCUMENTS

| | | | | |
|---|---|---|---|---|
| 2008/0266281 | A1 | 10/2008 | Li | |
| 2010/0127960 | A1* | 5/2010 | Jung | G09G 3/3688 345/89 |
| 2010/0207967 | A1* | 8/2010 | Baek | H03M 1/687 341/144 |
| 2010/0231564 | A1* | 9/2010 | Min | G09G 3/3648 345/96 |
| 2012/0182280 | A1* | 7/2012 | Park | G09G 3/3648 345/87 |
| 2015/0145758 | A1* | 5/2015 | Lee | G09G 3/3648 345/87 |
| 2015/0145898 | A1* | 5/2015 | Hwang | G09G 3/3614 345/96 |
| 2015/0310812 | A1* | 10/2015 | Chen | G09G 3/20 345/96 |
| 2016/0118000 | A1* | 4/2016 | Kim | G09G 3/3696 345/99 |
| 2016/0275840 | A1* | 9/2016 | Syu | G09G 3/3688 |

FOREIGN PATENT DOCUMENTS

| | | | |
|---|---|---|---|
| CN | 101290756 | A | 10/2008 |
| CN | 101295470 | A | 10/2008 |
| CN | 110867163 | A | 3/2020 |
| TW | 200842797 | A | 11/2008 |

* cited by examiner

LIQUID CRYSTAL DISPLAY GAMMA CIRCUIT OUTPUTTING POSITIVE AND NEGATIVE GAMMA REFERENCE VOLTAGE OCCUPYING SMALLER LAYOUT SPACE

This application claims priority to Chinese Patent Application No. 202110031377.3, filed on Jan. 11, 2021 and entitled "GAMMA CIRCUIT, METHOD FOR DRIVING THE SAME, AND DISPLAY PANEL", the disclosure of which is incorporated herein by reference in its entirety.

TECHNICAL FIELD

The present disclosure relates to the field of display technologies, and particularly relates to a gamma circuit, a method for driving the same, and a display panel.

BACKGROUND

In a liquid crystal display panel, a gamma circuit generally includes a voltage dividing circuit through which the gamma circuit can output a plurality of different gamma reference voltages. For example, the gamma reference voltages corresponding to positive and negative driving can be output.

It should be noted that the information disclosed in the background of the Description is only for enhancing the understanding of the background of the present disclosure, and thus it may include information that does not constitute the prior art known to those skilled in the art.

SUMMARY

The present disclosure provides a gamma circuit, a method for driving the same, and a display panel. The technical solutions are as follows.

According to an aspect of the present disclosure, a gamma circuit is provided. The gamma circuit includes:

a plurality of positive gamma voltage output terminals, wherein each of the positive gamma voltage output terminals is configured to output a positive gamma reference voltage;

a plurality of negative gamma voltage output terminals in one-to-one correspondence with the plurality of positive gamma voltage output terminals, wherein each of the negative gamma voltage output terminals is configured to output a negative gamma reference voltage; and a plurality of voltage conversion circuits, wherein each of the voltage conversion circuits is connected between the positive gamma voltage output terminal and the negative gamma voltage output terminal which correspond to each other, and is configured to output the negative gamma reference voltage to the negative gamma voltage output terminal based on the positive gamma reference voltage output by the positive gamma voltage output terminal.

In an exemplary embodiment of the present disclosure, the positive gamma reference voltage output by the positive gamma voltage output terminal and the negative gamma reference voltage output by the negative gamma voltage output terminal corresponding to the positive gamma voltage output terminal correspond to the same gray scale.

In another exemplary embodiment of the present disclosure, the voltage conversion circuit includes: a first switch sub-circuit, a second switch sub-circuit, a first storage sub-circuit, a second storage sub-circuit and a voltage control sub-circuit;

the first switch sub-circuit is connected to the positive gamma voltage output terminal, a first node and a clock signal terminal, respectively, and is configured to control a state of switched-on and switched-off between the positive gamma voltage output terminal and the first node in response to a clock signal provided by the clock signal terminal;

the second switch sub-circuit is connected to the first node, the clock signal terminal and a first power supply terminal, respectively, and is configured to control a state of switched-on and switched-off between the first power supply terminal and the first node in response to the clock signal;

the first storage sub-circuit is connected to the first node and a second node, respectively, and is configured to adjust the voltage of the first node and the voltage of the second node;

the second storage sub-circuit is connected to a second power supply terminal and the negative gamma voltage output terminal, respectively, and is configured to adjust the negative gamma reference voltage output by the negative gamma voltage output terminal based on a power supply signal provided by the second power supply terminal; and the voltage control sub-circuit is connected to the second node, the second power supply terminal and the negative gamma voltage output terminal, respectively, and is configured to adjust the voltage of the second node and the negative gamma reference voltage output by the negative gamma voltage output terminal based on the power supply signal provided by the second power supply terminal.

In another exemplary embodiment of the present disclosure, the voltage conversion circuit includes: a first switch sub-circuit, a second switch sub-circuit, a first storage sub-circuit, a second storage sub-circuit and a voltage control sub-circuit;

the anode of the first diode is connected to the second node, and the cathode of the first diode is connected to the second power supply terminal; and the anode of the second diode is connected to the negative gamma voltage output terminal, and the cathode of the second diode is connected to the second node.

In another exemplary embodiment of the present disclosure, the first switch sub-circuit includes:

a first switch transistor, wherein the gate of the first switch transistor is connected to the clock signal terminal, the first electrode of the first switch transistor is connected to the positive gamma voltage output terminal, and the second electrode of the first switch transistor is connected to the first node.

In another exemplary embodiment of the present disclosure, the second switch sub-circuit includes:

a second switch transistor, wherein the gate of the second switch transistor is connected to the clock signal terminal, the first electrode of the second switch transistor is connected to the first node, and the second electrode of the second switch transistor is connected to the first power supply terminal.

In another exemplary embodiment of the present disclosure, one of the first switch transistor and the second switch transistor is an N-type transistor, and the other switch transistor is a P-type transistor.

In another exemplary embodiment of the present disclosure, the first storage sub-circuit includes: a first capacitor, one end of the first capacitor is connected to the first node, and the other end of the first capacitor is connected to the second node.

In another exemplary embodiment of the present disclosure, the second storage sub-circuit includes:

a second capacitor, wherein one end of the second capacitor is connected to the second power supply terminal, and the other end of the second capacitor is connected to the negative gamma voltage output terminal.

In another exemplary embodiment of the present disclosure, the voltage of a power supply signal provided by the first power supply terminal is 0 volt.

In another exemplary embodiment of the present disclosure, the gamma circuit is applicable to a liquid crystal display panel, and the voltage Vref0 of the power supply signal provided by the second power supply terminal satisfies:

$$Vref0=2*Vcom+Vth1+Vth2+1,$$

wherein Vcom is the voltage of a common electrode of the liquid crystal display panel, Vth1 is the threshold voltage of the first diode, and Vth2 is the threshold voltage of the second diode.

In another exemplary embodiment of the present disclosure, Vth1 is equal to Vth2.

In another exemplary embodiment of the present disclosure, the gamma circuit further includes: a voltage dividing circuit; the voltage dividing circuit includes a plurality of voltage supply output terminals connected to the plurality of positive gamma voltage output terminals in one-to-one correspondence; and the voltage dividing circuit is further connected to a third power supply terminal and a ground terminal, respectively, and the voltage dividing circuit is configured to provide the positive gamma reference voltage to the positive gamma voltage output terminal by the voltage supply output terminal corresponding to the positive gamma voltage output terminal in response to a power supply signal provided by the third power supply terminal and a signal provided by the ground terminal.

In another exemplary embodiment of the present disclosure, the voltage dividing circuit further includes: a plurality of resistors and a plurality of capacitors, wherein the plurality of resistors is connected in series between the third power supply terminal and the ground terminal, and each of the voltage supply output terminals of the voltage dividing circuit is connected between every two adjacent resistors; and one end of each of the capacitors is connected to one of the voltage supply output terminals in one-to-one correspondence, and the other end of each of the capacitors is connected to the ground terminal.

In another exemplary embodiment of the present disclosure, the clock signal terminal is configured to alternately output a high-level clock signal and a low-level clock signal.

In another exemplary embodiment of the present disclosure, the plurality of voltage conversion circuits shares the same first power supply terminal, the same second power supply terminal and the same clock signal terminal.

According to another aspect of the present disclosure, a method for driving a gamma circuit is provided. The method is configured to drive the above gamma circuit, and includes:

outputting a positive gamma reference voltage by each of positive gamma voltage output terminals, and outputting a negative gamma voltage by each of voltage conversion circuits to a negative gamma voltage output terminal which corresponds to the positive gamma voltage output terminal based on the positive gamma reference voltage output by the positive gamma voltage output terminal which is connected to the voltage conversion circuit.

According to yet another aspect of the present disclosure, a display panel is provided. The display panel includes an array substrate and a gamma circuit, wherein at least part of the gamma circuit is integrated on the array substrate; and the gamma circuit includes:

a plurality of positive gamma voltage output terminals, wherein each of the positive gamma voltage output terminals is configured to output a positive gamma reference voltage;

a plurality of negative gamma voltage output terminals in one-to-one correspondence with the plurality of positive gamma voltage output terminals, wherein each of the negative gamma voltage output terminals is configured to output a negative gamma reference voltage; and a plurality of voltage conversion circuits, wherein each of the voltage conversion circuits is connected between the positive gamma voltage output terminal and the negative gamma voltage output terminal which correspond to each other, and is configured to output the negative gamma reference voltage to the negative gamma voltage output terminal based on the positive gamma reference voltage output by the positive gamma voltage output terminal.

In an exemplary embodiment of the present disclosure, the display panel further includes: a pixel driving circuit disposed on the array substrate, wherein the pixel driving circuit is formed on the same layer as the gamma circuit.

It should be understood that both the foregoing general description and the following detailed description are only exemplary and explanatory and are not restrictive of the present disclosure.

BRIEF DESCRIPTION OF THE DRAWINGS

The accompanying drawings, which are incorporated in and constitute a part of this Description, illustrate embodiments consistent with the present disclosure and, together with the Description, serve to explain the principles of the present disclosure. Apparently, the accompanying drawings in the following description show merely some embodiments of the present disclosure, and persons of ordinary skill in the art may still derive other drawings from these accompanying drawings without creative efforts.

DETAILED DESCRIPTION

Figure 1:
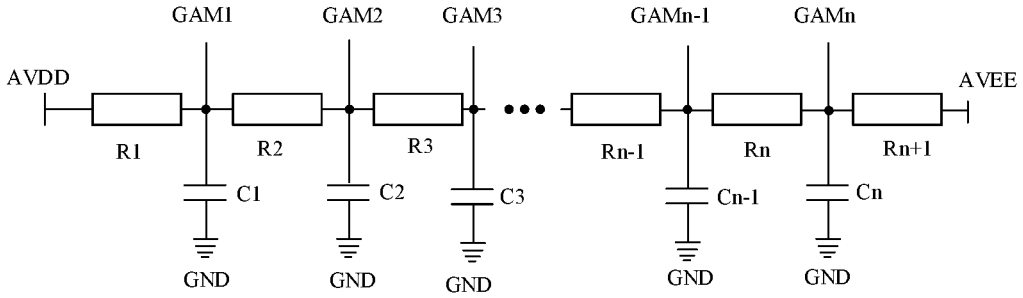
FIG. 1 (Prior Art)
FIG. 1 is a schematic structural diagram of a gamma circuit in the related art.

Exemplary embodiments are described more comprehensively below with reference to the accompanying drawings. However, the exemplary embodiments can be implemented in many forms and should not be construed as limited to the examples set forth herein. On the contrary, these embodiments provided will enable the present disclosure to be more thorough and complete, and fully convey the scope of the invention to those skilled in the art. In the drawings, the same reference numerals denote the same or similar structures, and thus the repeated description thereof will be omitted.

Although relative terms such as "upper" and "lower" are used in the Description to describe the relative relationship of one component with respect to another component as shown in the figures, these terms are used in the Description only for convenience, for example, based on the exemplary directions shown in the figures. It is to be understood that if an apparatus shown in the figures is turned upside down, the described "upper" component will become a "lower" component. Other relative terms, such as "high" and "low", "top", and "bottom", and "left" and "right" have similar meanings. When a structure is "on" another structure, it may mean that the structure is integrally formed on the another structure, or that the structure is "directly" arranged on the another structure, or that the structure is "indirectly" arranged on the another structure via still another structure.

The terms "a", "an", and "the" are configured to indicate the presence of one or more elements/components etc. The terms "include" and "have" are configured to indicate the meaning including an opening inclusion and indicate that there may be other elements/components etc. in addition to the listed elements/components/etc.

In the related art, in order to avoid polarization of liquid crystal, a liquid crystal display panel usually adopts positive and negative alternate driving modes to drive a liquid crystal layer, for example, frame inversion, dot inversion, column inversion, row inversion and other driving modes. Therefore, in the liquid crystal display panel, a gamma circuit needs to output a positive gamma reference voltage corresponding to positive driving and a negative gamma reference voltage corresponding to negative driving.

FIG. 1 is a schematic structural diagram of a gamma circuit in the related art. This gamma circuit includes a plurality of resistors R1, R2, . . . and Rn+1, and a plurality of capacitors C1, C2, . . . and Cn. The plurality of resistors R1, R2, . . . and Rn+1 is connected in series between a high-level terminal AVDD and a low-level terminal AVEE, and gamma voltage output terminals GAM1, GAM2, . . . and GAMn are connected between every two adjacent resistors, respectively. The plurality of C1, C2, . . . and Cn is arranged in one-to-one correspondence with the gamma voltage output terminals GAM1, GAM2, . . . and GAMn, and each capacitor is connected between its corresponding gamma voltage output terminal and ground terminal. Here, the gamma voltage output terminal is configured to output a gamma reference voltage.

The liquid crystal display panel needs to output the positive gamma reference voltage corresponding to the positive driving and the negative gamma reference voltage corresponding to the negative driving, and thus, the gamma circuit occupies a larger layout space of a circuit board as more resistors needs to be provided on the gamma circuit in the related art. In addition, since the negative gamma reference voltage generally has a negative voltage, the voltage value of a signal provided by the low-level terminal AVDD needs to be less than 0. Accordingly, the provision of the high-level terminal AVDD and the low-level terminal AVEE in the related art needs a DC-DC converter chip. However, the structure of the DC-DC converter chip is relatively complex and the cost is relatively high.

Figure 2:
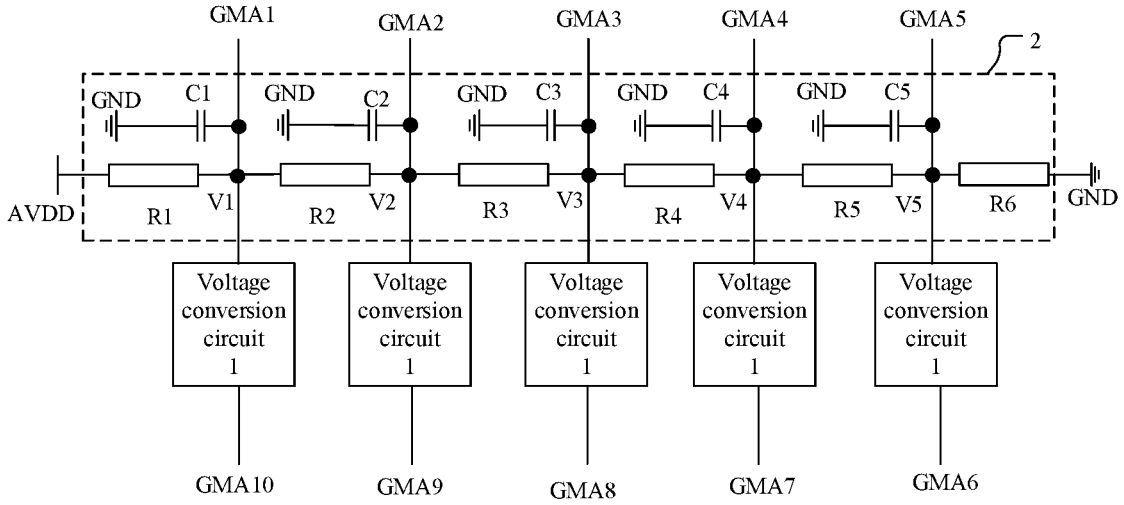
FIG. 2 is a schematic structural diagram of a gamma circuit according to an exemplary embodiment of the present disclosure.

Based on this, a gamma circuit is provided according to an embodiment of the present disclosure. FIG. 2 is a schematic structural diagram of the gamma circuit according to an embodiment of the present disclosure. The gamma circuit may include: a plurality of positive gamma voltage output terminals, a plurality of negative gamma voltage output terminals in one-to-one correspondence with the plurality of positive gamma voltage output terminals, and a plurality of voltage conversion circuits 1.

For example, the gamma circuit shown in FIG. 2 includes five positive gamma voltage output terminals GAM1, GAM2, GAM3, GAM4 and GAM5, and five negative gamma voltage output terminals GAM6, GAM7, GAM8, GAM9 and GAM10 in one-to-one correspondence with the five positive gamma voltage output terminals GAM1, GAM2, GAM3, GAM4 and GAM5. Here, the positive gamma voltage output terminal GAM1 corresponds to the negative gamma voltage output terminal GAM10, the positive gamma voltage output terminal GAM2 corresponds to the negative gamma voltage output terminal GAM9, the positive gamma voltage output terminal GAM3 corresponds to the negative gamma voltage output terminal GAM8, the positive gamma voltage output terminal GAM4 corresponds to the negative gamma voltage output terminal GAM7, and the positive gamma voltage output terminal GAM5 corresponds to the negative gamma voltage output terminal GAM6.

In the embodiment of the present disclosure, the positive gamma voltage output terminals (GAM1, GAM2, GAM3, GAM4 and GAM5 as shown in FIG. 2) are configured to output positive gamma reference voltages. The negative gamma voltage output terminals (GAM6, GAM7, GAM8, GAM9 and GAM10 as shown in FIG. 2) are configured to output negative gamma reference voltages. Each of the voltage conversion circuits 1 is connected between the positive gamma voltage output terminal and the negative gamma voltage output terminal which correspond to each other, and is configured to output the negative gamma reference voltage to the negative gamma voltage output terminal based on the positive gamma reference voltage output by the positive gamma voltage output terminal.

In the embodiment of the present disclosure, the positive gamma reference voltage is a gamma reference voltage corresponding to positive driving, and the negative gamma reference voltage is a gamma reference voltage corresponding to negative driving. The gamma circuit may be applicable to a liquid crystal display panel. Here, the positive gamma reference voltage may be greater than or equal to the voltage of a common electrode of the liquid crystal display panel, and the negative gamma reference voltage may be less than or equal to the voltage of the common electrode of the liquid crystal display panel. In other words, the positive gamma reference voltage may be greater than or equal to the negative gamma reference voltage.

In summary, the embodiment of the present disclosure provides the gamma circuit. Since the gamma circuit can output the negative gamma reference voltage to the negative gamma voltage output terminal based on the positive gamma reference voltage output by the positive gamma voltage output terminal via the voltage conversion circuit, some voltage dividing circuits for providing the negative gamma reference voltages to the negative gamma voltage output terminals are omitted compared with the related art, Thus, the number of the resistors is reduced.

Optionally, in the embodiment of the present disclosure, the gamma circuit may be directly integrated on an array substrate included in the display panel. In other words, the gamma circuit may be formed on the same layer as a pixel driving circuit in the array substrate via a patterning process, such that a layout space can be left on the circuit board to facilitate the layout design of the circuit board. It should be noted that the gamma circuit may also be only partially integrated on the array substrate. For example, only the voltage conversion circuits 1 in the gamma circuit may be integrated on the array substrate.

Optionally, the gamma circuit shown in FIG. 2 includes five positive gamma voltage output terminals and five negative gamma voltage output terminals. The gamma circuit may be applied to a 6-bit display panel (that is, the maximum gray scale of the display panel may be 63).

Figure 3:
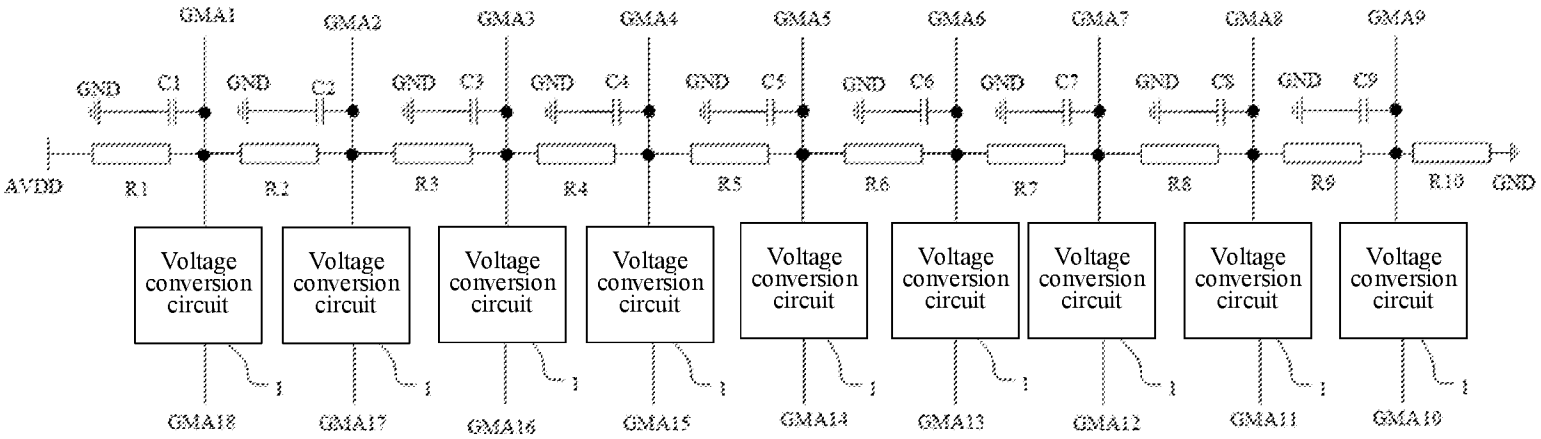
FIG. 3 is a schematic structural diagram of a gamma circuit according to another exemplary embodiment of the present disclosure.

It should be understood that in other exemplary embodiments, the gamma circuit may include the different number of positive gamma voltage output terminals and the different number of negative gamma voltage output terminals. For example, FIG. 3 is a schematic structural diagram of a gamma circuit according to another exemplary embodiment of the present disclosure. In an 8-bit display panel, the gamma circuit may include nine positive gamma voltage output terminals and nine negative gamma voltage output terminals. Accordingly, the gamma circuit may further include nine voltage conversion circuits 1.

In the embodiment of the present disclosure, the positive gamma reference voltage output by each of the positive gamma voltage output terminals and the negative gamma reference voltage output by the negative gamma voltage output terminal corresponding to the positive gamma voltage output terminal may correspond to the same gray scale.

For example, in the gamma circuit shown in FIG. 2, the positive gamma reference voltage output by the positive gamma voltage output terminal GAM1 and the negative gamma reference voltage output by the negative gamma voltage output terminal GAM10 may both correspond to 63 gray scales. The positive gamma reference voltage output by the positive gamma voltage output terminal GAM5 and the negative gamma reference voltage output by the negative gamma voltage output terminal GAM6 may both correspond to 0 gray scale.

In the embodiment of the present disclosure, the gamma circuit may provide the positive gamma reference voltage to the positive gamma voltage output terminal via a voltage dividing circuit. In other words, as shown in FIG. 2, the gamma circuit may further include a voltage dividing circuit 2. The voltage dividing circuit 2 may include a plurality of voltage supply output terminals connected to the plurality of positive gamma voltage output terminals in one-to-one correspondence. For example, the gamma circuit shown in FIG. 2 includes five positive gamma voltage output terminals GAM1, GAM2, GAM3, GAM4 and GAM5. Accordingly, the voltage dividing circuit includes five voltage supply output terminals V1, V2, V3, V4 and V5 connected to the plurality of positive gamma voltage output terminals GAM1, GAM2, GAM3, GAM4 and GAM5 in one-to-one correspondence.

In addition, referring to FIG. 2, it can be seen that the voltage dividing circuit 2 may further be connected to the third power supply terminal AVDD and the ground terminal GND, respectively. The voltage dividing circuit 2 may be configured to provide the positive gamma reference voltage to the positive gamma voltage output terminal by the voltage supply output terminal corresponding to the positive gamma voltage output terminal in response to a power supply signal provided by the third power supply terminal AVDD and a signal provided by the ground terminal GND.

In addition, referring to FIG. 2, it can be seen that in the embodiment of the present disclosure, the voltage dividing circuit 2 may further include a plurality of resistors and a plurality of capacitors.

Here, the plurality of resistors may be connected in series between the third power supply terminal AVDD and the ground terminal GND, and each of the voltage supply output terminals of the voltage dividing circuit 2 may be connected between every two adjacent resistors. The plurality of capacitors may be connected to the plurality of voltage supply output terminals in one-to-one correspondence, and each of the capacitors may be further connected to the ground terminal GND. The gamma circuit can adjust the voltages of the voltage output terminals by adjusting the resistance values of the plurality of resistors. The plurality of capacitors may be configured to stabilize the voltages of the voltage output terminals, respectively.

For example, FIG. 2 shows six resistors R1, R2, R3, R4, R5 and R6 connected in series between the third power supply terminal AVDD and the ground terminal GND, and five capacitors C1, C2, C3, C4 and C5 connected to the five voltage supply and output terminals V1, V2, V3, V4 and V5 in one-to-one correspondence. Each of the five voltage supply output terminals V1, V2, V3, V4 and V5 of the voltage dividing circuit 2 is connected between every two adjacent resistors. Each capacitor is further connected to the ground terminal GND. The gamma circuit can adjust the voltages of the five voltage supply output terminals V1, V2, V3, V4 and V5 by adjusting the resistance values of the six resistors R1, R2, R3, R4, R5 and R6. The plurality of capacitors C1, C2, C3, C4 and C5 may be configured to stabilize the voltages of the voltage supply output terminals V1, V2, V3, V4 and V5, respectively.

In the embodiment of the present disclosure, the voltage of the common electrode of the liquid crystal display panel may be greater than or equal to 0, such that the voltage of each of the positive gamma voltage output terminals is greater than or equal to 0. In addition, since the voltage dividing circuit 2 in the embodiment of the present disclosure only needs to be connected between the third power supply terminal AVDD and the ground terminal GND, compared with the related art shown in FIG. 1, the gamma circuit only needs to provide the third power supply terminal AVDD via the voltage conversion chip DC-DC, such that the structure of the DC-DC converter chip is simplified, and the cost of the display panel to which the gamma circuit is applicable is reduced.

It should be understood that in other exemplary embodiments, the gamma circuit may also provide the positive gamma reference voltage to the positive gamma voltage output terminal through other circuit structures, which belong to the protection scope of the present disclosure.

Figure 4:
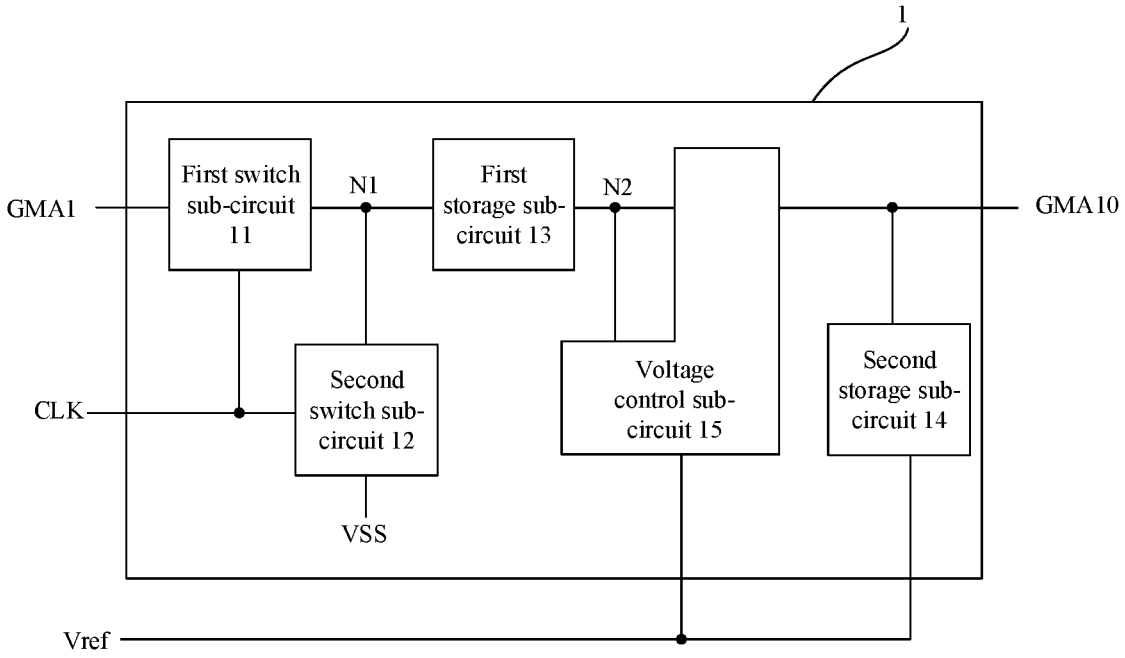
FIG. 4 is a schematic structural diagram of a voltage conversion circuit in a gamma circuit according to an exemplary embodiment of the present disclosure.

In the embodiment of the present disclosure, FIG. 4 is a schematic structural diagram of a voltage conversion circuit of a gamma circuit according to an exemplary embodiment of the present disclosure. The embodiment of the present disclosure takes the voltage conversion circuit connected between the positive gamma voltage output terminal GAM1 and the negative gamma voltage output terminal GAM10 as an example for illustration. The voltage conversion circuit 1 may include: a first switch sub-circuit 11, a second switch sub-circuit 12, a first storage sub-circuit 13, a second storage sub-circuit 14 and a voltage control sub-circuit 15.

Here, the first switch sub-circuit 11 may be connected to the positive gamma voltage output terminal GMA1, a first node N1 and the clock signal terminal CLK, respectively. In other words, the first switch sub-circuit 11 may connect the positive gamma voltage output terminal GAM1, the first node N1 and the clock signal terminal CLK. The first switch sub-circuit 11 may be configured to control a state of switched-on and switched-off between the positive gamma voltage output terminal GMA1 and the first node N1 in response to a clock signal provided by the clock signal terminal CLK.

For example, the first switch sub-circuit 11 may control the positive gamma voltage output terminal GMA1 and the first node N1 to be turned on when a level of the clock signal provided by the clock signal terminal CLK is an effective level. In other words, the first switch sub-circuit 11 may be configured to connect the positive gamma circuit output terminal GAM1 and the first node N1 in response to the clock signal provided by the clock signal terminal CLK. In addition, the first switch sub-circuit 11 may also control the positive gamma voltage output terminal GMA1 and the first node N1 to be disconnected when the level of the clock signal provided by the clock signal terminal CLK is an invalid level.

The second switch sub-circuit 12 may be connected to the first node N1, the clock signal terminal CLK and the first power supply terminal VSS, respectively. In other words, the second switch sub-circuit 12 may connect the first node N1, the clock signal terminal CLK and the first power supply terminal VSS. The second switch sub-circuit 12 may be configured to control a state of switched-on and switched-off between the first power supply terminal VSS and the first node N1 in response to a clock signal.

For example, the second switch sub-circuit 12 may control the first power supply terminal VSS and the first node N1 to be turned on when a level of the clock signal is an effective level. In other words, the second switch sub-circuit 12 may be configured to connect the first power supply terminal VSS and the first node N1 in response to the clock signal provided by the clock signal terminal CLK. In addition, the second switch sub-circuit 12 may also control the first power supply terminal VSS and the first node N1 to be disconnected when the level of the clock signal is an invalid level.

It should be noted that in the embodiment of the present disclosure, the polarity of a turn-on signal (namely, a signal that controls the turn-on between the positive gamma voltage output terminal GMA1 and the first node N1) of the first switch sub-circuit 11 and the polarity of a turn-on signal (namely, a signal that controls the turn-on between the first power supply terminal VSS and the first node N1) of the second switch sub-circuit 12 are opposite. For example, the first switch sub-circuit 11 may control the positive gamma voltage output terminal GMA1 and the first node N1 to be turned on under the action of a high-level clock signal, and control the positive gamma voltage output terminal GMA1 and the first node N1 to be disconnected under the action of a low-level clock signal. The second switch sub-circuit 12 may control the first power supply terminal VSS and the first node N1 to be turned on under the action of the low-level clock signal, and control the first power supply terminal VSS and the first node N1 to be disconnected under the action of the high-level clock signal. In other words, for the first switch sub-circuit 11, the effective level of its clock signal is the high level relative to the invalid level. For the second switch sub-circuit 12, the effective level of its clock signal is the low level relative to the invalid level.

The first storage sub-circuit 13 may be connected to the first node N1 and the second node N2, respectively. In other words, the first storage sub-circuit 13 may be connected between the first node N1 and the second node N2. The first storage sub-circuit 13 may be configured to adjust the voltage of the first node N1 and the voltage of the second node N2.

The second storage sub-circuit 14 may be connected to the second power supply terminal Vref and the negative gamma voltage output terminal GAM10, respectively. In other words, the second storage sub-circuit 14 may be connected between the second power supply terminal Vref and the negative gamma voltage output terminal GAM10. The second storage sub-circuit 14 may be configured to adjust the negative gamma reference voltage output by the negative gamma voltage output terminal GAM10 based on the power supply signal provided by the second power supply terminal Vref.

The voltage control sub-circuit 15 may be connected to the second node N2, the second power supply terminal Vref and the negative gamma voltage output terminal GAM10, respectively. The voltage control sub-circuit 15 may be configured to adjust the voltage of the second node N2 and the negative gamma reference voltage output by the negative gamma voltage output terminal GAM10 based on the power supply signal provided by the second power supply terminal Vref.

Figure 5:
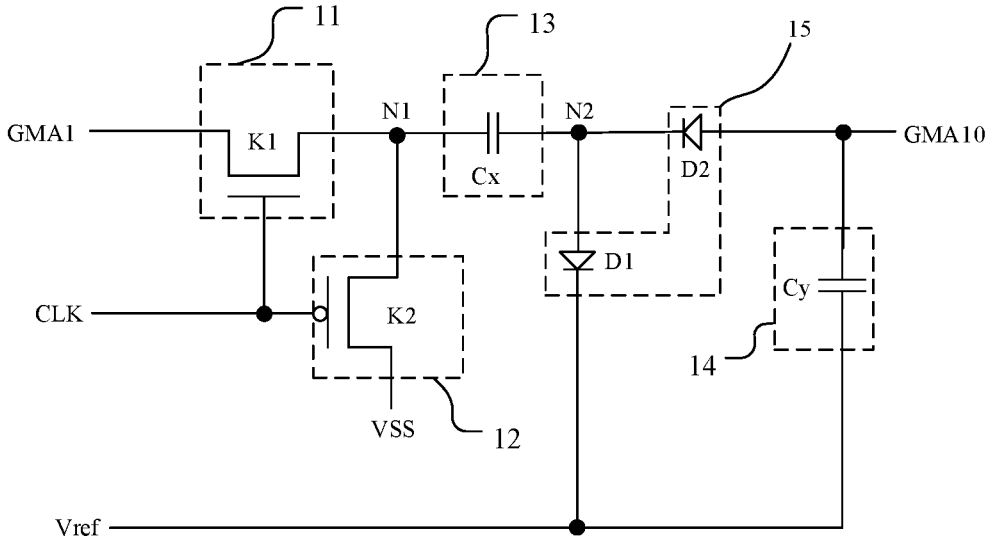
FIG. 5 is a schematic structural diagram of a voltage conversion circuit in a gamma circuit according to another exemplary embodiment of the present disclosure.

Optionally, FIG. 5 is a schematic structural diagram of a voltage conversion circuit in a gamma circuit according to an exemplary embodiment of the present disclosure. It can be seen from FIG. 5 that the voltage control sub-circuit 15 may include: a first diode D1 and a second diode D2.

Here, the anode of the first diode D1 may be connected to the second node N2, and the cathode of the first diode D1 may be connected to the second power supply terminal Vref.

The anode of the second diode D2 may be connected to the negative gamma voltage output terminal GAM10, and the cathode of the second diode D2 may be connected to the second node N2.

With continued reference to FIG. 5, the first switch sub-circuit 11 may include: a first switch transistor K1. The second switch sub-circuit 12 may include: a second switch transistor K2. The first storage sub-circuit 13 may include: a first capacitor Cx. The second storage sub-circuit 14 may include: a second capacitor Cy.

Here, the gate of the first switch transistor K1 may be connected to the clock signal terminal CLK; the first electrode of the first switch transistor K1 may be connected to the positive gamma voltage output terminal GAM1; and the second electrode of the first switch transistor K1 may be connected to the first node N1.

The gate of the second switch transistor K2 may be connected to the clock signal terminal CLK; the first electrode of the second switch transistor K2 may be connected to the first node N1; and the second electrode of the second switch transistor K2 may be connected to the first power supply terminal VSS.

One end of the first capacitor Cx may be connected to the first node N1, and the other end thereof may be connected to the second node N2. In other words, the first capacitor Cx may be connected between the first node N1 and the second node N2.

One end of the second capacitor Cy may be connected to the second power supply terminal Vref, and the other end thereof may be connected to the negative gamma voltage output terminal GAM10. In other words, the second capacitor Cy may be connected between the second power supply terminal Vref and the negative gamma voltage output terminal GAM10.

Optionally, in the embodiment of the present disclosure, one of the first switch transistor K1 and the second switch transistor K2 may be a P-type transistor, and the other switch transistor may be an N-type transistor. For example, in the voltage conversion circuit shown in FIG. 5, the first switch transistor K1 is the N-type transistor NTFT, and the second switch transistor K2 is the P-type transistor PTFT. In other words, the gate of the N-type transistor NTFT is connected to the clock signal terminal CLK, the first electrode of the N-type transistor NTFT is connected to the positive gamma voltage output terminal GAM1, and the second electrode of the N-type transistor NTFT is connected to the first node N1. The gate of the P-type transistor PTFT is connected to the clock signal terminal CLK, the first electrode of the P-type transistor PTFT is connected to the first node N1, and the second electrode of the P-type transistor PTFT is connected to the first power supply terminal VSS.

It should be understood that in other exemplary embodiments, the first switch sub-circuit 11, the second switch sub-circuit 12, the first storage sub-circuit 13 and the second storage sub-circuit 14 may also be of other structures. For example, the first switch sub-circuit 11 may include a P-type transistor, the second switch sub-circuit 12 may include an N-type transistor, and each of the first storage sub-circuit 13 and the second storage sub-circuit 14 may include a plurality of capacitors.

In the embodiment of the present disclosure, the first power supply terminal VSS may be a ground terminal. In other words, the voltage of the power supply signal provided by the first power supply terminal VSS may be 0 volt (V). The voltage Vref0 of the power supply signal provided by the second power supply terminal Vref may satisfy: Vref0=2*Vcom+Vth1+Vth2.

Here, Vcom is the voltage of the common electrode of the liquid crystal display panel; Vth1 is the threshold voltage of the first diode D1; and Vth2 is the threshold voltage of the second diode D2.

Optionally, the threshold voltage Vth1 of the first diode D1 may be equal to the threshold voltage Vth2 of the second diode D2. In addition, the plurality of voltage conversion circuits 1 in the gamma circuit may share the same first power supply terminal VSS, the same second power supply terminal Vref, and the same clock signal terminal CLK. Therefore, wiring can be simplified, and costs can be reduced.

In the embodiment of the present disclosure, the clock signal terminal CLK is configured to alternately output a high-level clock signal and a low-level clock signal. In other words, the levels of the clock signal are alternately high and low.

With reference to FIG. 5, since the first capacitor Cx can maintain the voltage of the second node N2 only when the first diode D1 is in a reverse bias state, the second node N2 can be charged to Vref0-Vth1 under the action of the slow leakage of the first diode D1. Here, the charging process of the second node N2 may experience multiple voltage variation cycles of the clock signal terminal CLK. After the charging of the second node N2 is completed, when the clock signal terminal CLK outputs a low-level clock signal, the first switch transistor K1 (namely, the N-type transistor NTFT) is turned off, and the second switch transistor K2 (namely, the P-type transistor PTFT) is turned on; the voltage of the first node N1 suddenly changes from Vgam1 to 0 V under the action of the power signal provided by the first power terminal VSS; and the voltage of the second node N2 suddenly changes to Vref0−Vth1−VGAM1 under the bootstrap of the first capacitor Cx, wherein Vgm1 is the positive gamma reference voltage output by the positive gamma voltage output terminal GAM1. At this time, the voltage of the second node N2 is less than Vref0−Vth1, and the second power supply terminal Vref will continue to charge the second node N2. However, due to the slow charging process and the relatively short maintenance time of the low level of the clock signal terminal CLK in a voltage change period, the voltage change of the second node N2 caused by the charging can be ignored. Meanwhile, since the second capacitor Cy can maintain the negative gamma reference voltage output by the negative gamma voltage output terminal GAM10 only when the second diode D2 is in the reverse bias state, the negative gamma reference voltage output by the negative gamma voltage output terminal GAM10 will be maintained at Vref0−Vth1−Vth2−Vgam1.

Here, with Vref0=2*Vcom+Vth1+Vth2, the negative gamma reference voltage output by the negative gamma voltage output terminal GAM10 may be equal to 2Vcom−Vgam1. In other words, the voltage difference between the negative gamma reference voltage output by the negative gamma voltage output terminal GAM10 and the voltage of the common electrode may be equal to the voltage difference between the positive gamma reference voltage output by the positive gamma voltage output terminal GAM1 and the voltage of the common electrode. Such a configuration can realize a symmetrical adjustment mode of the gamma circuit. In other words, under the same gray scale, the voltage difference between the positive driving voltage and the voltage of the common electrode is equal to the voltage difference between the negative driving voltage and the voltage of the common electrode.

It should be understood that in other exemplary embodiments, the voltage of the power supply signal provided by the second power supply terminal Vref may also have other values, and the gamma circuit may further realize an asymmetrical adjustment mode. In other words, under the same gray scale, the voltage difference between the positive driving voltage and the voltage of the common electrode may be different from the voltage difference between the negative driving voltage and the voltage of the common electrode.

In summary, the embodiment of the present disclosure provides the gamma circuit. Since the gamma circuit can output the negative gamma reference voltage to the negative gamma voltage output terminal based on the positive gamma reference voltage output by the positive gamma voltage output terminal via the voltage conversion circuit, some voltage dividing circuits for providing the negative gamma reference voltages to the negative gamma voltage output terminals are omitted compared with the related art. Thus, the number of the resistors is reduced.

Figure 6:
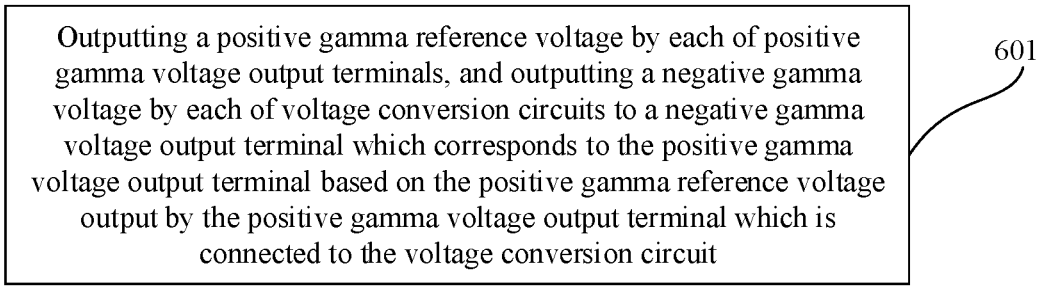
FIG. 6 is a flowchart of a method for driving a gamma circuit according to an exemplary embodiment of the present disclosure.

FIG. 6 is a flowchart of a method for driving a gamma circuit according to an embodiment of the present disclosure. The method may be configured to drive any of the gamma circuits described in the above embodiments. As shown in FIG. 6, the driving method may include the following step.

In 601, a positive gamma reference voltage is output by each of positive gamma voltage output terminals, and a negative gamma voltage is output to a negative gamma voltage output terminal which corresponds to the positive gamma voltage output terminal by each of voltage conversion circuits based on the positive gamma reference voltage output by the positive gamma voltage output terminal which is connected to the voltage conversion circuit.

In other words, the positive gamma reference voltage can be output by using the positive gamma voltage output terminal. Then, the negative gamma voltage is output by the voltage conversion circuit to the negative gamma voltage output terminal corresponding to the positive gamma voltage output terminal based on the positive gamma reference voltage.

In summary, the embodiment of the present disclosure provides the method for driving the gamma circuit. In the method, since the gamma circuit can output the negative gamma reference voltage to the negative gamma voltage output terminal based on the positive gamma reference voltage output by the positive gamma voltage output terminal via the voltage conversion circuit, some voltage dividing circuits for providing the negative gamma reference voltages to the negative gamma voltage output terminals are omitted compared with the related art. Thus, the number of the resistors is reduced.

Figure 7:
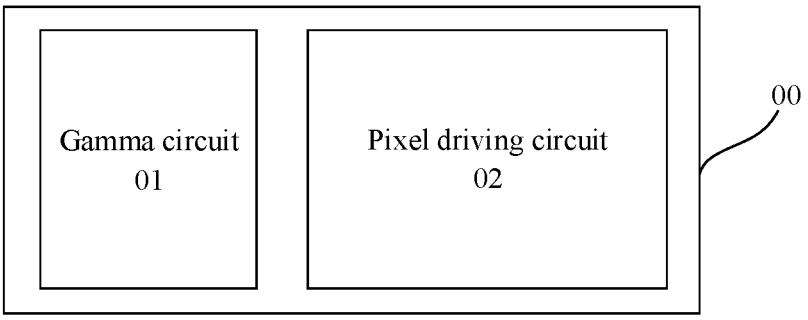
FIG. 7 is a schematic structural diagram of a display panel according to an exemplary embodiment of the present disclosure.

FIG. 7 is a schematic structure diagram of a display panel according to an embodiment of the present disclosure. As shown in FIG. 7, the display panel may include an array substrate 00 and the gamma circuit 01 described in any of the above embodiments.

Here, at least part of the gamma circuit 01 may be integrated on the array substrate 00. For example, only the voltage conversion circuits in the gamma circuit 01 may be integrated on the array substrate 00. Alternatively, referring to FIG. 7, the gamma circuit 01 may be integrally integrated on the array substrate 00. Therefore, the narrow frame design of the display panel can be facilitated.

Optionally, with continued reference to FIG. 7, it can be seen that the display panel may further include: a pixel driving circuit 02 disposed on the array substrate 00 (namely, integrated on the array substrate 00).

Optionally, the gamma circuit 01 may be formed on the same layer as the pixel driving circuit 02 via a patterning process, such that a layout space can be left on the circuit board to facilitate the layout design of the circuit board. It should be noted that the gamma circuit may also be only partially integrated on the array substrate.

Optionally, the gamma circuit 01 may be formed on the side of the display panel where the source driving circuit is disposed, so as to be connected to the source driving circuit.

Other embodiments of the present disclosure may be available to those skilled in the art upon consideration of the description and practice of the invention disclosed herein. The present disclosure is intended to cover any variations, uses, or adaptations of the present disclosure following general principles of the present disclosure and including the common general knowledge or conventional technical means in the art which is not disclosed in the present disclosure. The Description and embodiments are to be considered as exemplary only, and a true scope and spirit of the present disclosure is indicated by the claims.

It should be understood that the present disclosure is not limited to the precise structures described above and shown in the accompanying drawings, and that various modifications and changes may be made without departing from the scope thereof. The scope of the present disclosure is only subject to the appended claims.

What is claimed is:

1. A gamma circuit, comprising:

a plurality of positive gamma voltage output terminals, wherein each of the plurality of positive gamma voltage output terminals is configured to output a positive gamma reference voltage;

a plurality of negative gamma voltage output terminals in one-to-one correspondence with the plurality of positive gamma voltage output terminals, wherein each of the plurality of negative gamma voltage output terminals is configured to output a negative gamma reference voltage; and a plurality of voltage conversion circuits, wherein each of the plurality of voltage conversion circuits is connected between a positive gamma voltage output terminal and a negative gamma voltage output terminal which correspond to each other, and is configured to output the negative gamma reference voltage to the negative gamma voltage output terminal based on the positive gamma reference voltage output by the positive gamma voltage output terminal;

wherein a voltage conversion circuit comprises: a first switch sub-circuit, a second switch sub-circuit, a first storage sub-circuit, a second storage sub-circuit and a voltage control sub-circuit;

the first switch sub-circuit is connected to the positive gamma voltage output terminal, a first node and a clock signal terminal, respectively, and is configured to control a state of switched-on and switched-off between the positive gamma voltage output terminal and the first node in response to a clock signal provided by the clock signal terminal;

the second switch sub-circuit is connected to the first node, the clock signal terminal and a first power supply terminal, respectively, and is configured to control a state of switched-on and switched-off between the first power supply terminal and the first node in response to the clock signal;

the first storage sub-circuit is connected to the first node and a second node, respectively, and is configured to adjust a voltage of the first node and a voltage of the second node;

the second storage sub-circuit is connected to a second power supply terminal and the negative gamma voltage output terminal, respectively, and is configured to adjust the negative gamma reference voltage output by the negative gamma voltage output terminal based on a power supply signal provided by the second power supply terminal; and the voltage control sub-circuit is connected to the second node, the second power supply terminal and the negative gamma voltage output terminal, respectively, and is configured to adjust the voltage of the second node and the negative gamma reference voltage output by the negative gamma voltage output terminal based on the power supply signal provided by the second power supply terminal.

2. The gamma circuit according to claim 1, wherein the positive gamma reference voltage output by the positive gamma voltage output terminal and the negative gamma reference voltage output by the negative gamma voltage output terminal corresponding to the positive gamma voltage output terminal correspond to a same gray scale.

3. The gamma circuit according to claim 1, wherein the voltage control sub-circuit comprises: a first diode and a second diode;

an anode of the first diode is connected to the second node, and a cathode of the first diode is connected to the second power supply terminal; and an anode of the second diode is connected to the negative gamma voltage output terminal, and a cathode of the second diode is connected to the second node.

4. The gamma circuit according to claim 3, wherein the gamma circuit is applicable to a liquid crystal display panel, and a voltage Vref0 of the power supply signal provided by the second power supply terminal satisfies:

$Vref0=2*Vcom+Vth1+Vth2$, wherein Vcom is a voltage of a common electrode of the liquid crystal display panel, Vth1 is a threshold voltage of the first diode, and Vth2 is a threshold voltage of the second diode.

5. The gamma circuit according to claim 4, wherein Vth1 is equal to Vth2.

6. The gamma circuit according to claim 1, wherein the first switch sub-circuit comprises:

a first switch transistor, wherein a gate of the first switch transistor is connected to the clock signal terminal, a first electrode of the first switch transistor is connected to the positive gamma voltage output terminal, and a second electrode of the first switch transistor is connected to the first node.

7. The gamma circuit according to claim 6, wherein the second switch sub-circuit comprises:

a second switch transistor, wherein a gate of the second switch transistor is connected to the clock signal terminal, a first electrode of the second switch transistor is connected to the first node, and a second electrode of the second switch transistor is connected to the first power supply terminal.

8. The gamma circuit according to claim 7, wherein one of the first switch transistor and the second switch transistor is an N-type transistor, and the other switch transistor is a P-type transistor.

9. The gamma circuit according to claim 8, wherein the positive gamma reference voltage output by the positive gamma voltage output terminal and the negative gamma reference voltage output by the negative gamma voltage output terminal corresponding to the positive gamma voltage output terminal correspond to a same gray scale;

the voltage control sub-circuit comprises: a first diode and a second diode; an anode of the first diode is connected to the second node, and a cathode of the first diode is connected to the second power supply terminal; an anode of the second diode is connected to the negative gamma voltage output terminal, and a cathode of the second diode is connected to the second node;

the first storage sub-circuit comprises: a first capacitor, one end of the first capacitor is connected to the first node, and the other end of the first capacitor is connected to the second node;

the second storage sub-circuit comprises a second capacitor, one end of the second capacitor is connected to the second power supply terminal, and the other end of the second capacitor is connected to the negative gamma voltage output terminal;

a voltage of a power supply signal provided by the first power supply terminal is 0 volt;

the gamma circuit is applicable to a liquid crystal display panel, and a voltage Vref0 of the power supply signal provided by the second power supply terminal satisfies: Vref0=2Vcom+Vth1+Vth2, wherein Vcom is a voltage of a common electrode of the liquid crystal display panel, Vth1 is a threshold voltage of the first diode, Vth2 is a threshold voltage of the second diode, and Vth1 is equal to Vth2;

the gamma circuit further comprises: a voltage dividing circuit; the voltage dividing circuit comprises a plurality of voltage supply output terminals connected to the plurality of positive gamma voltage output terminals in one-to-one correspondence;

the voltage dividing circuit is further connected to a third power supply terminal and a ground terminal, respectively, and is configured to provide the positive gamma reference voltage to the positive gamma voltage output terminal by the voltage supply output terminal corresponding to the positive gamma voltage output terminal in response to a power supply signal provided by the third power supply terminal and a signal provided by the ground terminal;

the voltage dividing circuit further comprises: a plurality of resistors and a plurality of capacitors; the plurality of resistors is connected in series between the third power supply terminal and the ground terminal, and each of the voltage supply output terminals of the voltage dividing circuit is connected between every two adjacent resistors; one end of each of the capacitors is connected to one of the voltage supply output terminals in one-to-one correspondence, and the other end of each of the capacitors is connected to the ground terminal;

the clock signal terminal is configured to alternately output a high-level clock signal and a low-level clock signal; and the plurality of voltage conversion circuits shares the same first power supply terminal, the same second power supply terminal and the same clock signal terminal.

10. The gamma circuit according to claim 1, wherein the first storage sub-circuit comprises: a first capacitor, one end of the first capacitor is connected to the first node, and the other end of the first capacitor is connected to the second node.

11. The gamma circuit according to claim 1, wherein the second storage sub-circuit comprises:

a second capacitor, wherein one end of the second capacitor is connected to the second power supply terminal, and the other end of the second capacitor is connected to the negative gamma voltage output terminal.

12. The gamma circuit according to claim 1, wherein a voltage of a power supply signal provided by the first power supply terminal is 0 volt.

13. The gamma circuit according to claim 1, further comprising: a voltage dividing circuit, wherein the voltage dividing circuit comprises a plurality of voltage supply output terminals connected to the plurality of positive gamma voltage output terminals in one-to-one correspondence; and the voltage dividing circuit is further connected to a third power supply terminal and a ground terminal, respectively, and the voltage dividing circuit is configured to provide the positive gamma reference voltage to the positive gamma voltage output terminal by the voltage supply output terminal corresponding to the positive gamma voltage output terminal in response to a power supply signal provided by the third power supply terminal and a signal provided by the ground terminal.

14. The gamma circuit according to claim 13, wherein the voltage dividing circuit further comprises: a plurality of resistors and a plurality of capacitors, wherein the plurality of resistors is connected in series between the third power supply terminal and the ground terminal, and each of the plurality of voltage supply output terminals of the voltage dividing circuit is connected between every two adjacent resistors; and one end of each of the plurality of capacitors is connected to one of the plurality of voltage supply output terminals in one-to-one correspondence, and another end of each of the plurality of capacitors is connected to the ground terminal.

15. The gamma circuit according to claim 1, wherein the clock signal terminal is configured to alternately output a high-level clock signal and a low-level clock signal.

16. The gamma circuit according to claim 1, wherein the plurality of voltage conversion circuits shares the same first power supply terminal, the same second power supply terminal and the same clock signal terminal.

17. A method for driving a gamma circuit, comprising:

outputting a positive gamma reference voltage by each of positive gamma voltage output terminals, and outputting a negative gamma voltage by each of the plurality of voltage conversion circuits to a negative gamma voltage output terminal which corresponds to the positive gamma voltage output terminal based on a positive gamma reference voltage output by the positive gamma voltage output terminal which is connected to a voltage conversion circuit;

wherein the voltage conversion circuit comprises: a first switch sub-circuit, a second switch sub-circuit, a first storage sub-circuit, a second storage sub-circuit and a voltage control sub-circuit;

the first switch sub-circuit is connected to the positive gamma voltage output terminal, a first node and a clock signal terminal, respectively, and is configured to control a state of switched-on and switched-off between the positive gamma voltage output terminal and the first node in response to a clock signal provided by the clock signal terminal;

the second switch sub-circuit is connected to the first node, the clock signal terminal and a first power supply terminal, respectively, and is configured to control a state of switched-on and switched-off between the first power supply terminal and the first node in response to the clock signal;

the first storage sub-circuit is connected to the first node and a second node, respectively, and is configured to adjust a voltage of the first node and a voltage of the second node;

the second storage sub-circuit is connected to a second power supply terminal and the negative gamma voltage output terminal, respectively, and is configured to adjust the negative gamma reference voltage output by the negative gamma voltage output terminal based on a power supply signal provided by the second power supply terminal; and the voltage control sub-circuit is connected to the second node, the second power supply terminal and the negative gamma voltage output terminal, respectively, and is configured to adjust the voltage of the second node and the negative gamma reference voltage output by the negative gamma voltage output terminal based on the power supply signal provided by the second power supply terminal.

18. A display panel, comprising an array substrate and a gamma circuit, wherein at least part of the gamma circuit is integrated on the array substrate; and the gamma circuit comprises:

a plurality of positive gamma voltage output terminals, wherein each of the plurality of positive gamma voltage output terminals is configured to output a positive gamma reference voltage;

a plurality of negative gamma voltage output terminals in one-to-one correspondence with the plurality of positive gamma voltage output terminals, wherein each of the plurality of negative gamma voltage output terminals is configured to output a negative gamma reference voltage; and a plurality of voltage conversion circuits, wherein each of the plurality of voltage conversion circuits is connected between a positive gamma voltage output terminal and a negative gamma voltage output terminal which correspond to each other, and is configured to output the negative gamma reference voltage to the negative gamma voltage output terminal based on the positive gamma reference voltage output by the positive gamma voltage output terminal;

wherein a voltage conversion circuit comprises: a first switch sub-circuit, a second switch sub-circuit, a first storage sub-circuit, a second storage sub-circuit and a voltage control sub-circuit;

the first switch sub-circuit is connected to the positive gamma voltage output terminal, a first node and a clock signal terminal, respectively, and is configured to control a state of switched-on and switched-off between the positive gamma voltage output terminal and the first node in response to a clock signal provided by the clock signal terminal;

the second switch sub-circuit is connected to the first node, the clock signal terminal and a first power supply terminal, respectively, and is configured to control a state of switched-on and switched-off between the first power supply terminal and the first node in response to the clock signal;

the first storage sub-circuit is connected to the first node and a second node, respectively, and is configured to adjust a voltage of the first node and a voltage of the second node;

the second storage sub-circuit is connected to a second power supply terminal and the negative gamma voltage output terminal, respectively, and is configured to adjust the negative gamma reference voltage output by the negative gamma voltage output terminal based on a power supply signal provided by the second power supply terminal; and the voltage control sub-circuit is connected to the second node, the second power supply terminal and the negative gamma voltage output terminal, respectively, and is configured to adjust the voltage of the second node and the negative gamma reference voltage output by the negative gamma voltage output terminal based on the power supply signal provided by the second power supply terminal.

19. The display panel of claim 18, further comprising: a pixel driving circuit disposed on the array substrate, wherein the pixel driving circuit is formed on the same layer as the gamma circuit.

* * * * *